US008914918B2

(12) United States Patent
Swanson et al.

(10) Patent No.: US 8,914,918 B2
(45) Date of Patent: Dec. 23, 2014

(54) ANTI-HORSE COLLAR TACKLE SAFETY DEVICE

(76) Inventors: Kevin Swanson, Wagoner, OK (US); Dustin Thomas Swanson, Wagoner, OK (US)

( * ) Notice: Subject to any disclaimer, the term of this patent is extended or adjusted under 35 U.S.C. 154(b) by 708 days.

(21) Appl. No.: 13/236,429

(22) Filed: Sep. 19, 2011

(65) Prior Publication Data

US 2012/0066821 A1 Mar. 22, 2012

Related U.S. Application Data

(60) Provisional application No. 61/384,615, filed on Sep. 20, 2010, provisional application No. 61/406,487, filed on Oct. 25, 2010, provisional application No. 61/535,844, filed on Sep. 16, 2011.

(51) Int. Cl.
*A41D 13/00* (2006.01)
*A41D 27/26* (2006.01)
*A41D 13/05* (2006.01)

(52) U.S. Cl.
CPC ..... *A41D 13/0512* (2013.01)
USPC ..... 2/468

(58) Field of Classification Search
CPC . A41D 13/015; A41D 13/0153; A41D 13/05; A41D 13/0512; A41D 13/0531
USPC ..... 2/468; 602/17, 18, 19; 128/869, 870, 128/871
See application file for complete search history.

(56) References Cited

U.S. PATENT DOCUMENTS 5,483,698 A * 1/1996 Douglas, Jr. ..... 2/462

OTHER PUBLICATIONS

Filing Receipt and Specification for provisional patent application entitled "Anti-Horse Collar Tackle Safety Device," by Kevin Swanson, filed Sep. 20, 2010 as U.S. Appl. No. 61/384,615.
Filing Receipt and Specification for provisional patent application entitled "Anti-Horse Collar Tackle Safety Device," by Kevin Swanson, filed Oct. 25, 2010 as U.S. Appl. No. 61/406,487.
Filing Receipt and Specification for provisional patent application entitled "Anti-Horse Collar Tackle Safety Device," by Kevin Swanson, filed Sep. 16, 2011 as U.S. Appl. No. 61/535,844.

* cited by examiner

*Primary Examiner* — Amber Anderson
(74) *Attorney, Agent, or Firm* — Conley Rose, P.C.; Rodney B. Carroll

(57) ABSTRACT

An anti-horse collar tackle safety device, comprising a base having means for attaching the base to a pair of shoulder pads, wherein the base comprises an interior portion facing the shoulder pads and an exterior portion that is accessible from outside a jersey placed over the shoulder pads, and a releasable portion releasably attached to the exterior portion of the base via means for releasable attachment, wherein the releasable portion is configured to release via application of a force equal to or less than about 15 pounds.

16 Claims, 6 Drawing Sheets

ANTI-HORSE COLLAR TACKLE SAFETY DEVICE

CROSS REFERENCE TO RELATED APPLICATIONS

This application claims priority to U.S. Provisional Patent Application No. 61/384,615 filed Sep. 20, 2010, 61/406,487 filed Oct. 25, 2010, and 61/535,844 filed Sep. 16, 2011, all entitled "Anti-Horse Collar Tackle Safety Device," each of which is hereby incorporated herein by reference in its entirety for all purposes.

STATEMENT REGARDING FEDERALLY SPONSORED RESEARCH OR DEVELOPMENT

Not Applicable.

FIELD OF THE INVENTION

The present invention generally relates to a device, system and method for preventing injuries and unsportsmanlike conduct in contact sports. Specifically, this invention relates to a device, system and method for preventing horse-collar tackles.

BACKGROUND OF THE INVENTION

A horse-collar tackle is a defensive move used in American football to stop a ball-carrying player. The defender grabs the back of the shoulder pads or jersey collar of the ball-carrying player and pulls the player to the ground. Because the tackled player falls in a backward twisting motion, one or both legs can be caught under the weight of the tackled player's body potentially resulting in injury. The potential for injuries can be further exacerbated if the player's foot becomes caught in the turf and/or by the impact and weight of the defender's body. Possible injuries to the tackled player include sprains or tears to ligaments in the knees and ankles including the ACL and MCL and fractures of the tibia and fibula.

Because of the injury risk associated with the horse-collar tackle, the National Football League banned the horse-collar tackle after the 2005 season. In 2006, the NCAA outlawed the tackle, and in 2009, the National Federation of State High School Associations followed suit. The use of a horse-collar tackle during game play results in a 15-yard penalty due to personal foul.

Even with the horse-collar tackle ban in place, the horse-collar tackle continues to occur in game play. Coaches, teams or individual players may strategically decide that a 15-yard penalty is preferable to allowing the opposing team a scoring opportunity. Also, inadvertent horse-collar tackles may still occur in the confusion or excitement of a game. As such, offensive players are still at risk of a horse-collar tackle and the related injuries. Therefore, a need exists for athletic safety equipment that prevents horse-collar tackles and protects a player from the possible injuries associated with being the recipient of such a maneuver.

SUMMARY OF THE INVENTION

In summary, the present invention relates to an athletic safety device, system, and method for use in preventing injuries and unsportsmanlike conduct, specifically horse-collar tackles. The athletic safety device is situated at the back shoulders, neck, and upper spine of an athlete. Further, the athletic safety device is designed to be releasably attached to a piece of athletic equipment or to an attaching base such that when grabbed by an opposing player, the athletic safety device releases from the athletic equipment or attaching base to which it was attached.

In an embodiment, the athletic safety device is composed of an upper cushioning portion, a lower support portion, and means for releasably attaching the cushioned support to athletic equipment such as a jersey or shoulder pads or to an attaching base. The upper cushioning portion may be thicker than the lower support portion and composed of an impact absorbent material. The upper cushioning portion is designed to sit behind the neck of the athlete. Extending downward from the upper cushion portion is the lower support portion. The lower support portion may be composed of an impact absorbent material. A plastic insert may be situated within the impact absorbent material of the lower support portion to provide structural support. In an additional embodiment, the athletic safety device also includes a fixed or removable outer cover.

In an embodiment, the athletic safety device is composed of a releasable portion or member, a support base, and means for releasably attaching (e.g., hook and loop fastener such as Velcro™) the releasable portion to the support base. In an embodiment, the support member is securely attached to a piece of athletic equipment such as a jersey or shoulder pads.

In an alternate embodiment, the athletic safety device is composed of a cushioned support and means for releasably attaching the cushioned support to athletic equipment such as a jersey or shoulder pads or to an attaching base. The cushioned support is made from an impact absorbent material and is designed to sit behind the neck of the athlete. In an embodiment, the athletic safety device also includes a fixed or removable outer cover.

In another embodiment, the present invention pertains to an athletic safety system for preventing injuries associated with horse-collar tackles. The system includes an athletic safety device, a piece of athletic equipment, and optionally a support base. In one embodiment of this system, the athletic safety device and the piece of athletic equipment have a cooperative means for releasably attaching the athletic safety device to the piece of athletic equipment. In an alternative embodiment of this system, the athletic safety device and the support base, which is affixed to the piece of athletic equipment, have a cooperative means for releasably attaching the athletic safety device to the support base. In both embodiments, the athletic device is releasably attached such that the athletic safety device is positioned at the back shoulders, neck and upper spine of an athlete. Further, the athletic safety device may be releasably attached in such a way that when grabbed by an opposing player during game play, the safety device will release from the equipment or attaching base to which it is attached, thereby preventing a horse-collar tackle and possibility for resultant injury to the athlete.

In yet another embodiment, the present invention is directed to a method for preventing injury to an athlete due to horse-collar tackling. The method includes releasably attaching an athletic safety device to a piece of equipment to be worn by an athlete or, alternatively, releasably attaching an athletic safety device to a support base, which is affixed to a piece of equipment to be worn by an athlete. The athletic safety device should be releasably attached in such a way that the athletic safety device is situated at the back shoulders, neck, and upper spine of the athlete. Further, the athletic safety device should be releasably attached in such a way that when grabbed by an opposing player during game play, the athletic safety device will release from the equipment or support base to which it is attached, thereby preventing a horse-collar tackle and possibility for resultant injury to the athlete.

BRIEF DESCRIPTION OF THE DRAWINGS

For a better understanding of the nature of the features of the invention, reference should be made to the following detailed description taken in conjunction with the accompanying drawings, in which.

DETAILED DESCRIPTION OF THE INVENTION

Figure 1A:
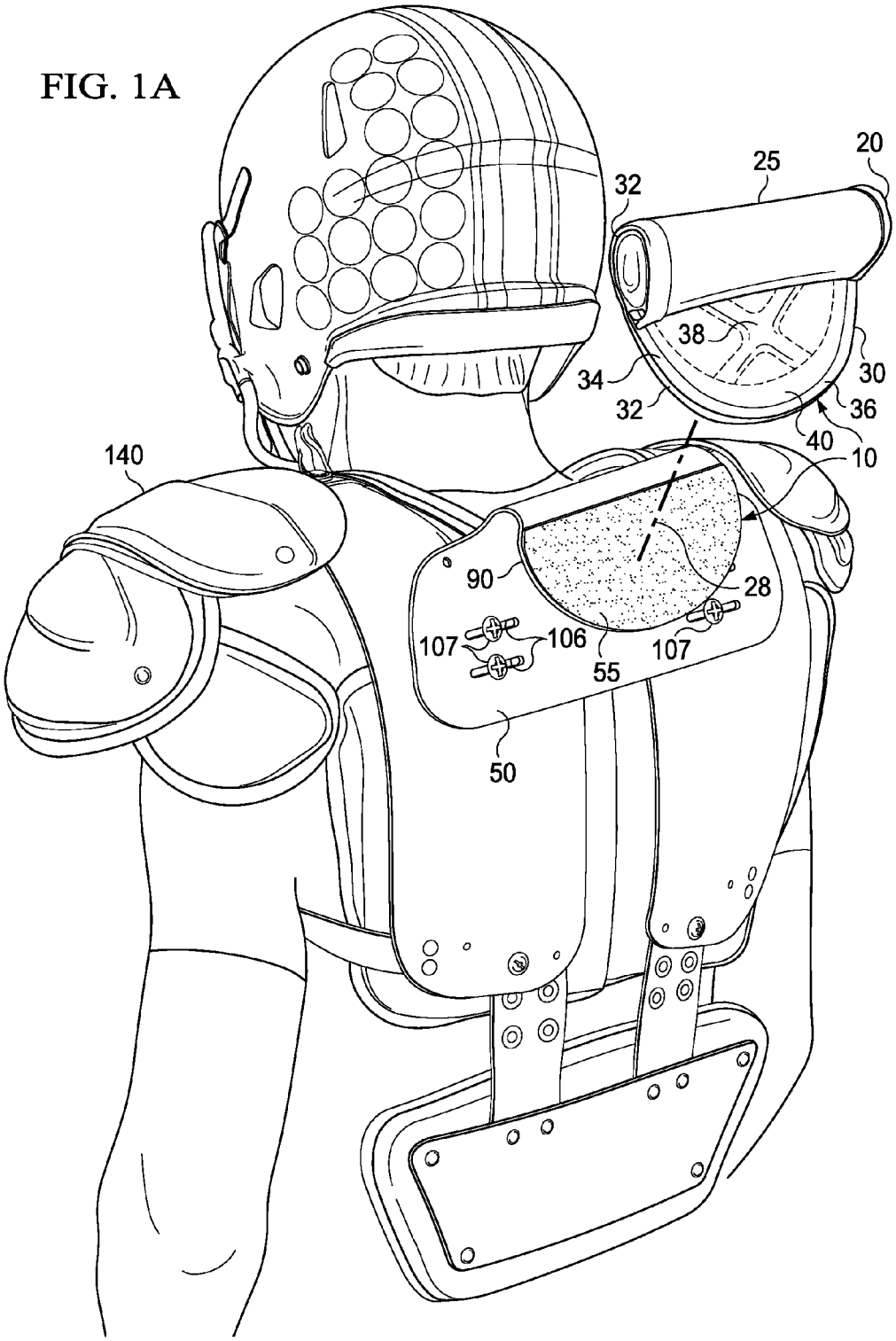
FIGS. 1A and 1B are perspective rear views of a football player wearing shoulder pads having an embodiment of the safety device attached thereto.

Unless otherwise specified, use of the term "releasably attached" or "breakaway" shall be construed as components joined together in such a way that when one component is pulled it releases from the other components while being worn in game play, which is in contrast to components of athletic equipment that may be removed before or after play but are not designed to release, break away, tear away, or otherwise come off during game play. In various embodiments, the force required to release components releasably attached may be varied, for example, by varying the size, number, and/or type of means for releasably attaching as will be described in more detail herein, or by the manner in which the releasable components are engaged (for example, "locking" hook and loop elements by side to side motion while engaging the components). In an embodiment, the safety device comprises a releasable portion attached to a piece of athletic equipment and/or a supporting base, and the force required to release the releasable portion from the athletic equipment and/or supporting base is greater than 0 and less than about 25, 20, 15, or 10 pounds, alternatively equal to our greater than about 1, 2, 3 pounds and equal to or less than or 15 or 10 pounds, alternatively, equal to or greater than about 2-3 pounds and equal to or less than about 10 pounds, alternatively, about 3-5 pounds, about 5-10 pounds, or about 8-9 pounds. In an embodiment, the force is measured via a force measuring device (e.g., a scale) attached to the releasable portion and pulled by a human until the releasable portion releases. In an embodiment, the force may be applied at any angle between about parallel and about perpendicular to an outer face of a lip of the supporting base, as described in more detail herein, and further provided that the force required to release the releasable portion at any such angle does not exceed a desired maximum. In an embodiment, the safety device comprises a releasable portion attached to a means for releasable attachment (and the means for releasable attachment is further connected directly or indirectly to a piece of athletic equipment, for example via a supporting base), and the force required to release the releasable portion via the means for releasable attachment (i.e., the force required to separate the components via the means for releasable attachment such as a hook and loop fastener) is less than the force required to tear or forcibly separate the means for releasable attachment from the athletic equipment and/or supporting base (e.g., less than the force required to tear, forcibly remove, or otherwise cause a structural failure in the supporting base or component thereof when installed on a pair of shoulder pads). Also, the means for releasably attaching may be further configured such that they are responsive to directional differences in the application of the force required to release components releasably attached thereby. For example, the means for releasably attaching may be configured such that application of a force in a direction substantially perpendicular to the back or shoulder blades of an athlete wearing the device results in a magnitude of force required to release the components that is less than a magnitude of force required to release the components when the force is applied in a direction other than substantially perpendicular (e.g., a force substantially parallel to the back or shoulder blades of an athlete wearing the device). In an embodiment, the means for releasably attaching are configured such that the athletic safety device described herein releases more readily (e.g., with less force) when pulled from behind a player wearing it than when pulled from a side of the player wearing it.

Figure 1B:
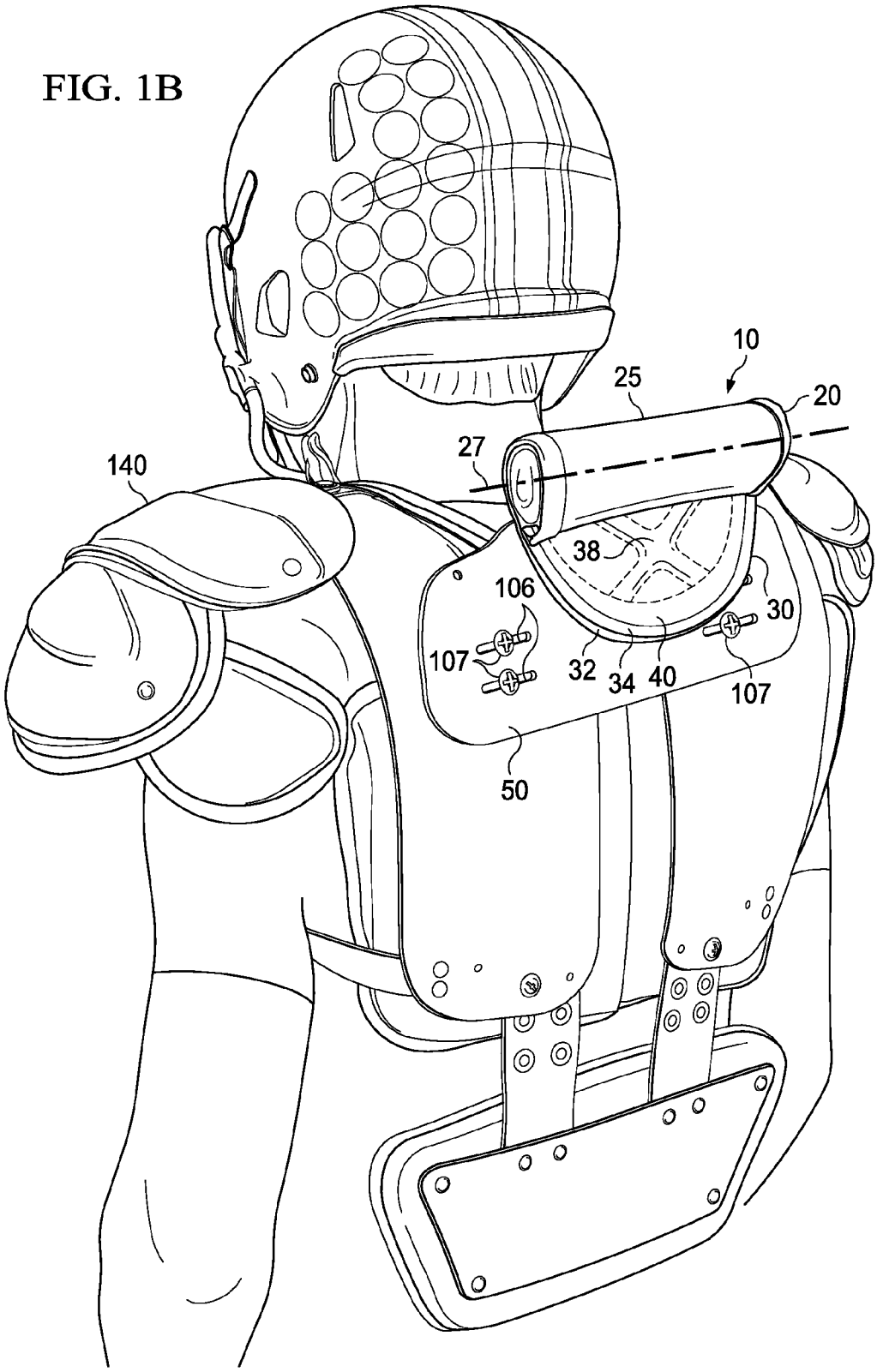
Figure 2:
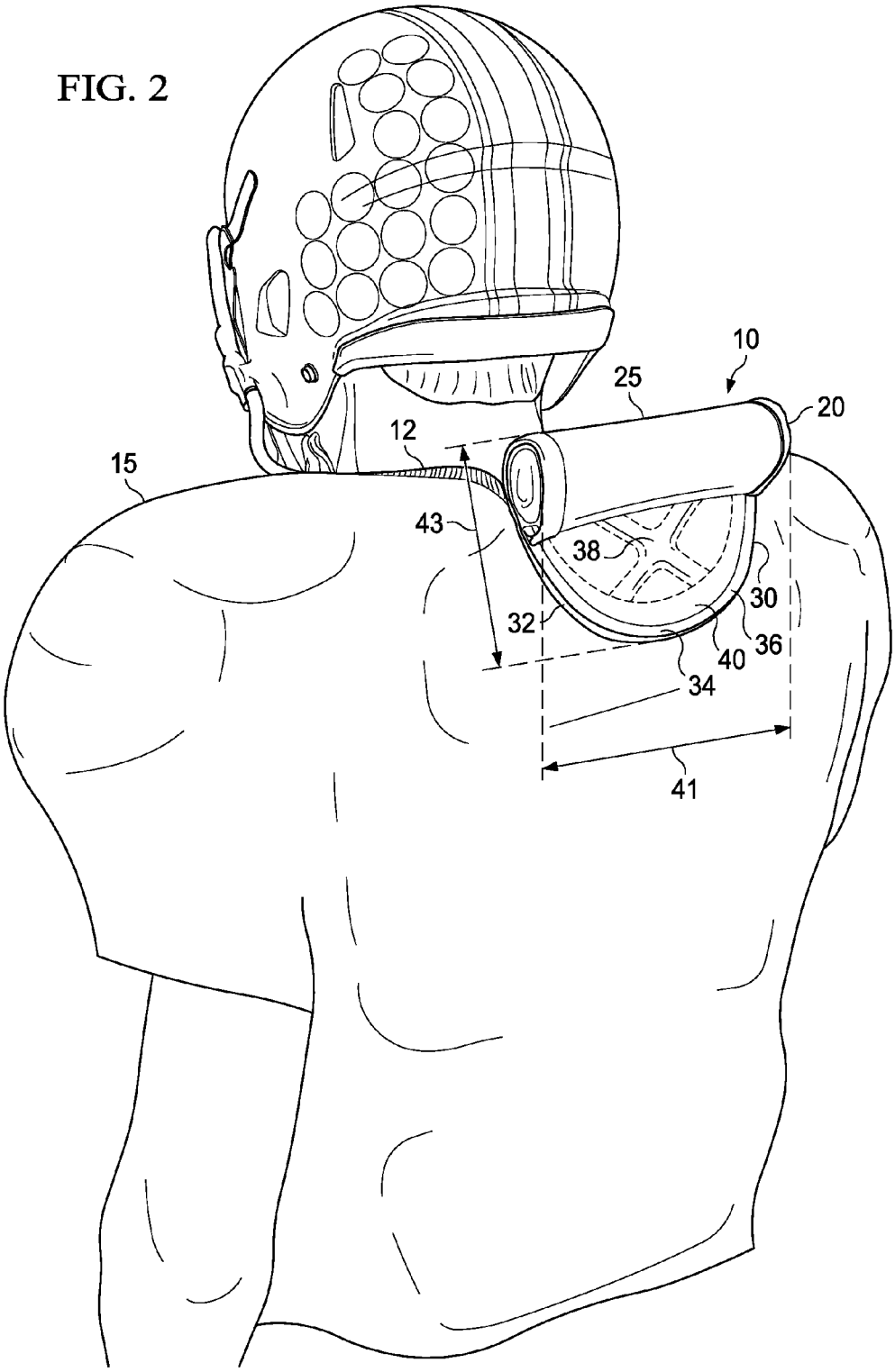
FIG. 2 is a perspective rear view of a football player wearing shoulder pads having an embodiment of the safety device attached thereto, and further having a jersey on over the shoulder pads and exposing a releasable portion of the safety device.

The present invention relates to an athletic safety device and methods of use designed to protect an athlete from horse-collar tackles in contact sports such as, for example, American football, rugby, and hockey. In an embodiment as shown in FIGS. 1 and 2, the athletic safety device 10, or a portion thereof, is designed to be releasably attached to a piece of athletic equipment (e.g., athletic jersey and/or shoulder pads) and configured/attached in such a way that it is positioned adjacent the upper back, shoulders, lower neck and upper spine of an athlete. In an additional embodiment, the athletic safety device may be sized and/or positioned such that that when the athlete is approached and/or grabbed from behind in a horse-collar tackle maneuver, the opposing player perpetuating the tackle may not be able to grasp and/or access the athletic shoulder pads (e.g., collar) and/or athletic jersey (e.g., back fabric or collar) of the athlete. The athletic safety device, or a portion thereof, is releasably attached so that should the opposing player successfully grab the athletic safety device in an effort to perform a horse-collar tackle, the athletic safety device will release from the athletic equipment to which it is attached, and the horse-collar tackle will not be completed.

Figure 3:
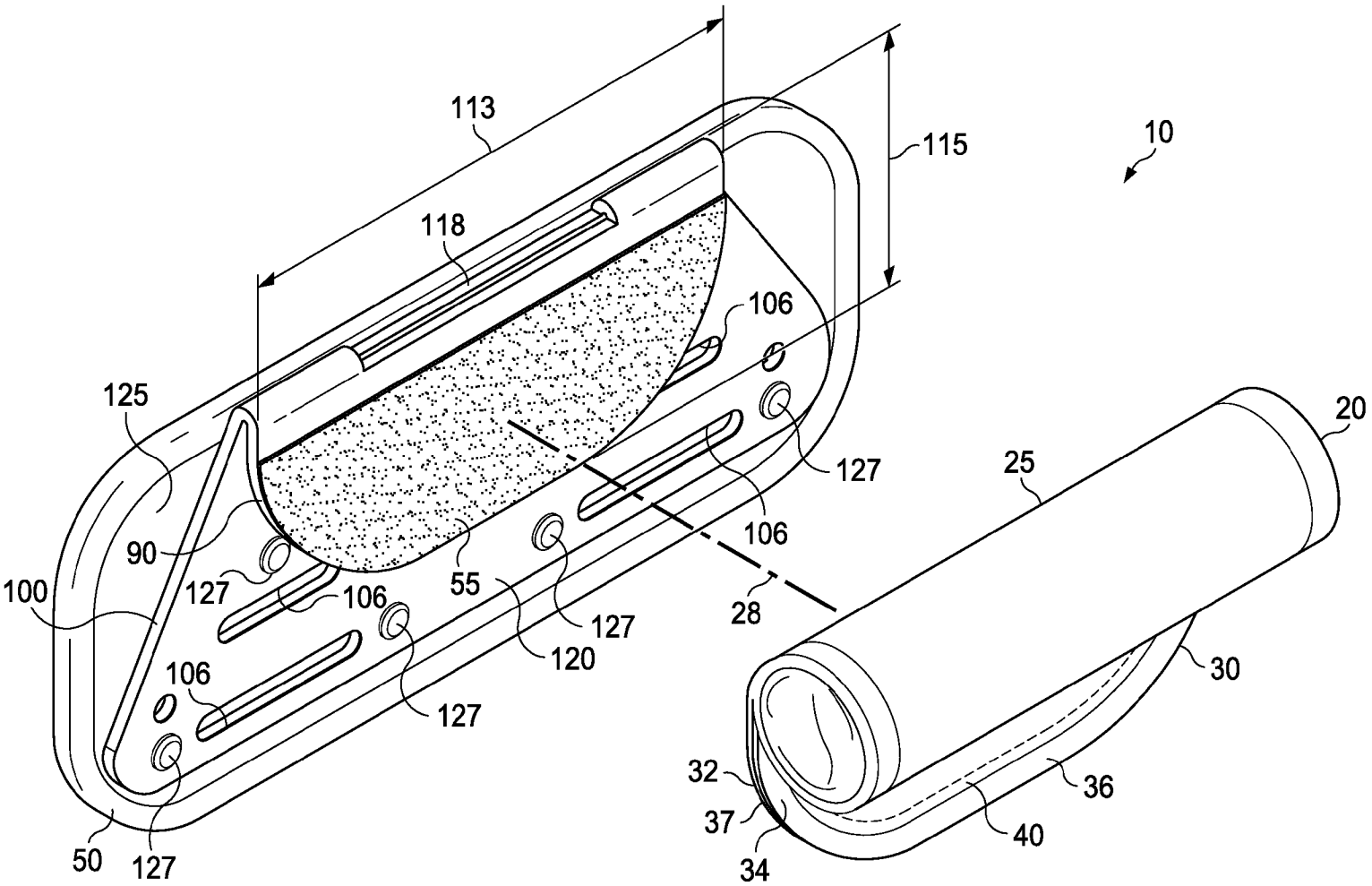
FIG. 3 is a perspective view of an embodiment of the safety device showing the releasably attaching relationship of the releasable portion and the supporting base.

In the embodiment illustrated by FIGS. 1-3, the athletic safety device 10 comprises a releasable portion or member 25 and a supporting base portion or member (e.g., a base) 50. In an embodiment, the releasable portion 25 further comprises an upper cushioning portion 20 (e.g., a neck roll or collar) and a lower support portion 30. As can be seen in FIG. 3, the upper cushioning portion 20 is typically thicker than the lower support portion 30. As can be seen in FIG. 2, the upper cushioning portion 20 is designed to extend up beyond the collar 12 of an athletic jersey 15 and sit behind an athlete's neck such that access to the collar of the shoulder pads and/or athletic jersey is substantially prevented and/or impeded. The upper cushioning portion 20 is composed of an impact absorbent material such as, for example, foam rubber, polyurethane foam, latex foam rubber, visco-elastic polyurethane foam (e.g., memory or slow recovery foam), polyester foam, neoprene rubber, and the like. In an embodiment, the foam is integral skin foam, for example, having a high density skin and a low density core. In an embodiment, a foam core is encased within a protective skin layer such as neoprene rubber skin layer, which may be used alone or in combination with a fixed or removable cover (e.g., cloth or fabric cover) described in more detail herein.

In an embodiment, the upper cushioning portion 20 can be shaped as a cylinder or any other shape suitable for the purposes of the invention (e.g., circular, oval, square, rectangular, or trapezoidal cross-sections). In an embodiment, the upper cushioning portion is a cylinder with tapered ends forming a crescent roll shape. In an embodiment, the upper cushioning portion has a generally circular cross-section and has a diameter of equal to or greater than 1, 1.25, 1.5, 1.75, 2, 2.25, 2.5, 2.75, or 3 inches. Other cross-sectional shapes may be selected and sized to have a cross-sectional area about equal to those defined for a generally circular cross-section for each given diameter (e.g., area=$\pi r^2$).

In another embodiment, the upper cushioning portion 20 is sized and shaped so that the upper cushioning portion extends around or substantially around the neck of the athlete (e.g., along the collar 12 or neckline of the jersey 15), thereby preventing horse-collar tackle attempts from either side of the athlete as well as preventing horse-collar tackle attempts from directly behind. In such an embodiment, the upper cushioning portion 20 may be generally cylindrical (e.g., straight or tapered cylinder), crescent shaped, or U-shaped, with the understanding that any other shape suitable for the purposes of the invention can be used. Further, in such an embodiment, the length of the upper cushioning portion should be sized suitably for the purposes of the invention. In an embodiment, the upper cushioning portion 20 is an about straight cylinder having a length of about 4, 5, 6, 7, 8, 9, or 10 inches. In an alternatively embodiment, the length of the upper cushioning portion 20 may be characterized as an arc substantially defined by a focal point at the spine and spanning about 180° from shoulder to shoulder, alternatively, spanning about 170°, alternatively, about 160°, alternatively, about 150°, alternatively about 140°, alternatively about 130°, alternatively about 120°, alternatively, spanning any other degree suitable for the purposes of the invention. In an alternative embodiment, the length of the upper cushioning portion 20 is determined by line segment formed by the intersection of a plane horizontal with a player's back and one of the arcs described above. The upper cushioning portion 20 may taper towards each of the terminal ends, so that the center of the upper cushioning portion is taller than the terminal ends.

Referring to FIGS. 1-3, extending downward from the upper cushioning portion 20 is the lower support portion 30. In an embodiment, the lower support portion is generally square, rectangular, or other quadrilateral in shape. In another embodiment, the lower support portion is shaped as a half-circle, semi-circle, or other circular segment defined by a chord, for example, a half-circle such as an about 180° arc from a center point of the upper cushioning portion 20. It should be understood that other suitable shapes may be used. The lower support portion 30 may comprise a plastic insert 32 and an impact absorbent material 34 such as, for example, foam rubber. The lower support portion 30 may have a thickness 37 of equal to or less than 2, 1.75, 1.5, 1.25, 1, 0.75, 0.5 or 0.25 inches. The plastic insert 32 provides structure and support for the releasable portion 25. Also, the lower support portion 30 can be sized and/or positioned to substantially prevent and/or impede the grasping of the middle back portion of an athletic jersey to prevent a player from being brought down from behind via the jersey in a manner similar to a horse-collar tackle made by grasping the collar of the shoulder pads and/or jersey. In embodiments, the releasable portion 25 may have a generally rectangular or square outline or perimeter (and optionally a curved lower portion) having a width 41 and length/height 43. In an embodiment, the width 41 is about equal to the length/height 43, for example about 4×4, 4.5×4.5, 5×5, 5.5×5.5, 6×6, 6.5×6.5, 7×7, 7.5×7.5, 8×8, 8.5×8.5, or 9×9 inches. In an alternative embodiment, the width 41 and length/height 43 are different and may be independently selected as 3, 3.5, 4, 4.5, 5, 5.5, 6, 6.5, 7, 7.5, 8, 8.5, or 9 inches. In an embodiment, the plastic insert 32 is encased within the impact absorbent material 34. For example, in one embodiment, the plastic insert 32 is encased by a U-shaped section of impact absorbent material 34, which forms a raised border or edge along the sides of the lower support portion and an interior recessed area. In another embodiment, the plastic insert 32 is covered by a solid piece of impact absorbent material. In other embodiments, the plastic insert 32 may be encased in a section of impact absorbent material of any shape suitable for the purposes of the invention. In an embodiment, the exterior side of the lower support portion (i.e., the side facing away from the player wearing the safety device) comprises a raised border 36, a raised and/or stitched cross-member support 38 (e.g., a center "X"), or both. In an embodiment, the cross-member support 38 may provide additional structural integrity to the lower support portion. In an embodiment, the cross-member 38 is located in an interior recessed portion formed by a raised border/edge 36 positioned along the outer edge of the exterior side of the lower support portion. In an embodiment, the safety device 10 is referred to as an X-COLLAR, and is commercially available from X Collar Corporation, Wagoner, Okla.

In one embodiment, the upper cushioning portion 20 and the lower support portion 30 are constructed from a solid, unitary, or continuous piece of material (e.g., monolithic or integral with each other). In another embodiment, the upper cushioning portion 20 and the lower support portion 30 are made from two separate pieces of material and are affixed or connected together. In this embodiment, the portions 20 and 30 may be affixed together with glue, stitching, staples, brads, rivets, or any other known mechanism suitable for the purposes of the invention. In an embodiment, the portions 20 and 30 are held in position relative to one another by a covering, coating, jacket, film, fabric, or the like. In an embodiment, the safety device is made via a molding process. For example, the plastic insert 32 may be first formed (e.g., stamped or molded), placed into a mold, and the impact absorbent material 34 injected into the mold (e.g., injection of expanding foam material) and thereby forming the upper cushioning portion 20 and/or impact absorbing material portions surrounding the plastic insert. In an embodiment such as shown in FIG. 1A, the plastic insert 32 extends within the space defining the upper cushioning portion 20 such that the plastic insert provides additional structural reinforcement to the finished article and helps avoid separation via wear and tear of the applying and removing the safety device during normal use. In an embodiment, the plastic insert 32 and the remaining portions of the releasable portion 25 (e.g., the portions comprising the impact absorbent material 34) are made in the same mold, for example, sequentially or simultaneously (co-injected). In an embodiment, the impact absorbent material 34 is further treated or coated, for example, a protective skin layer (e.g., rubber skin) may be applied subsequent to or during formation of the releasable portion 25. In an embodiment, the releasable portion 25 has a fixed or removable cover 40, for example a fabric cover. In an embodiment, one or more components of the safety device 10 (e.g., all or a portion of the base 50 and/or the releasable portion 25 such as impact absorbent material 34 and/or cover 40) is treated with an antifungal, antibacterial, and/or antimicrobial material or compound (e.g., MICROBAN™)

In an alternative embodiment, the athletic safety device is composed of a cushioned support (e.g., neck roll) and means for releasably attaching the cushioned support to athletic equipment such as a jersey or shoulder pads or to an attaching base, and in such an embodiment the lower support potion is optional and may be omitted. As can be seen in FIGS. 1 and 2, the cushioned support is designed to extend up beyond the collar of an athletic jersey and sit behind an athlete's neck. The cushioned support is composed of an impact absorbent material such as, for example, foam rubber and can be shaped as a cylinder, or any other shape suitable for the purposes of the invention. The cushioned support may also be shaped so that it extends around or substantially around an athlete's neck as described previously herein. In an embodiment, the cushioned support is releasable attached directly to the jersey, for example via a hook and loop fastener stitched to the jersey below the collar or neckline.

The athletic safety device 10 may be to be releasably attached to a piece of athletic equipment such as, for example, an athletic jersey 15, athletic shoulder pads 140, a supporting base 50, or combination thereof by any suitable means for releasable attachment. As can be seen in FIGS. 1A and 3, in an embodiment, the athletic safety device 10 comprises a releasable portion 25 releasably attached (as represented by line 28) to a base 50 using hook-and-loop fasteners 55 such as, for example, Velcro™, for example with the hook side on the releasable portion and the loop side on the base (or alternatively on the athletic equipment such as shoulder pads and/or jersey). Alternatively, the releasable portion may be attached to the piece of athletic equipment (e.g., directly and/or via the base 50) using hook-and-loop fasteners 55 such as, for example, Velcro™ with the loop side on the athletic safety device and the hook side on the piece of athletic equipment (directly and/or via the base 50), or vice-versa. The size, position, and/or configuration of the hook-and-loop fasteners 55 may be selected to achieve a desired release profile to affix the safety device (e.g., the releasable portion 25) such that is does not come off during regular game play and is desirably released when a sufficient force is applied when an opposing player grasps the device in an attempt to perform an illegal horse-collar tackle. Thus, the size, position, and/or configuration of the hook-and-loop fasteners 55 may be selected to release more readily when pulled from behind by an opposing player in contrast to be pulled from the side or other direction. While a single patch or strip of hook-and-loop fasteners 55 is shown in FIGS. 1A and 3, more than one patch or strip may be employed, for example, edge or border strips running along one more of the edges defined by width 41 and length 43. In an embodiment, the area of the patch of hook-and-loop fasteners 55 is equal to or greater than 10, 20, 30, 40, 50, 60, 70, 80, 90, or 100% of the area of the lower support potion 30, for example as defined by the width 41 and the length 43 of FIG. 2. In another embodiment, the athletic safety device (e.g., the releasable portion 25) is releasably attached with snaps to the piece of athletic equipment (e.g., via base 50 affixed to the athletic equipment). In other embodiments, the athletic safety device may be releasably attached, either directly (e.g., via hook and loop fasteners on the jersey) and/or indirectly (e.g., via the base attached to the shoulder pads) to the piece of athletic equipment (e.g., jersey and/or shoulder pads) using any method, structure or means for releasably attaching that are suitable for the purposes of the invention.

In the embodiments as shown in FIGS. 1 and 2, the athletic safety device 10 comprises a releasable portion 25 that is releasably attached to the base 50, which is affixed to a piece or pieces of athletic equipment (e.g., shoulder pads 140) such that the athletic equipment does not have to be altered or changed in order to install and use the athletic safety device 10 (e.g., Velcro™ need not be sewn onto the jersey). The base 50 may be referred to by other terms such as a base plate, base pad, mounting plate, shoulder pad plate, Velcro™ support plate, attaching base, support/supporting plate, support/supporting base, etc. In one embodiment, the base 50 is comprised of plastic and/or cushioning material such as described herein (e.g., foam rubber). In other embodiments, the base 50 may be comprised of any other material or combinations of materials suitable for the purposes of the invention. In an embodiment, the releasable portion 25 may be releasably attached to the base 50 using hook-and-loop fasteners 55 such as, for example, Velcro™ with the hook side releasable portion 25 and the loop side on the base 50, or vice-versa. The size, position, and/or configuration of the hook-and-loop fasteners 55 may be selected to achieve a desired release profile to affix the device to the base 50 such that it does not come off during regular game play and is desirably released when a sufficient force is applied when an opposing player grasps the device in an attempt to perform an illegal horse-collar tackle. Thus, the size, position, and/or configuration of the hook-and-loop fasteners 55 may be selected to release more readily when pulled from behind by an opposing player in contrast to be pulled from the side or other direction. In another embodiment, the releasable portion 25 is releasably attached to the base 50 with snaps. In other embodiments, the releasable portion 5 may be releasably attached to the base 50 using any method, structure or means for releasably attaching that are suitable for the purposes of the invention.

Figure 5:
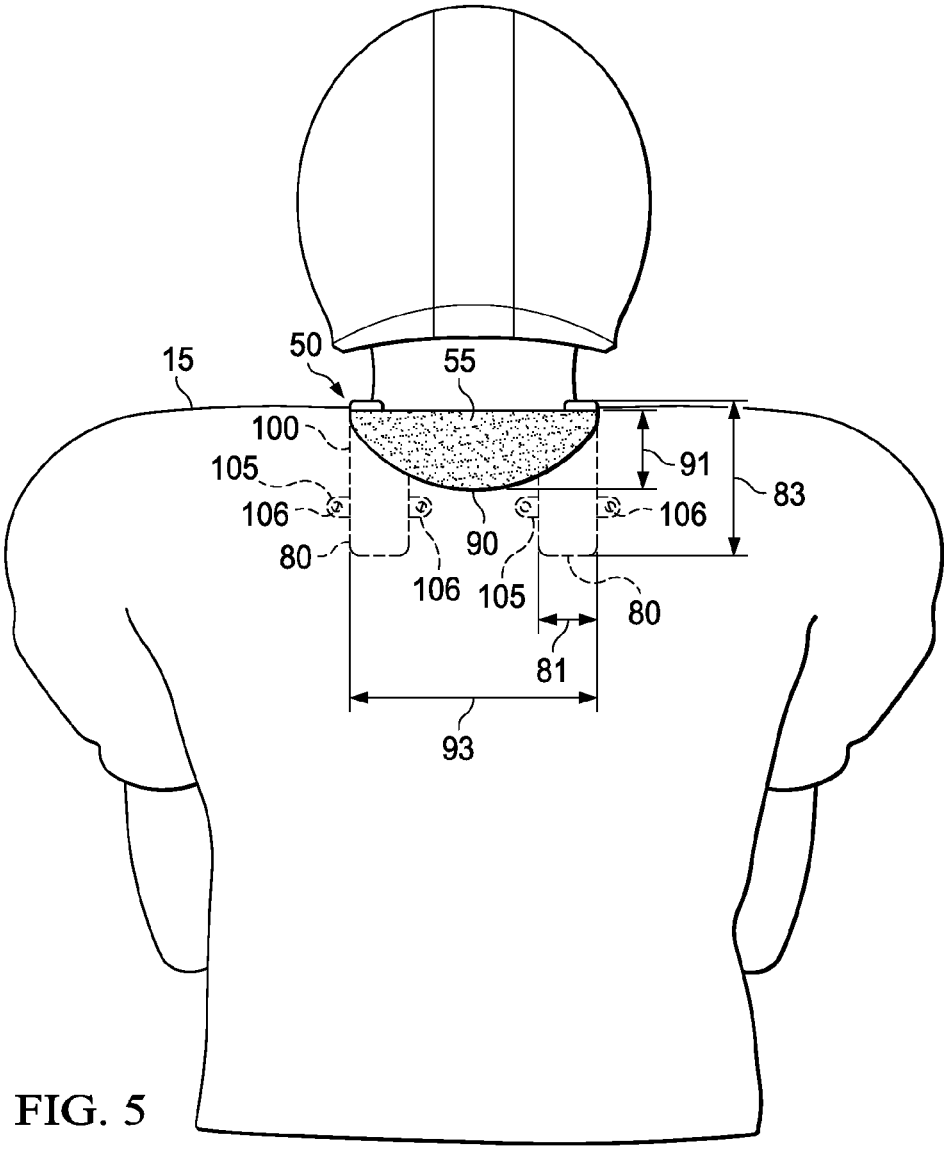
FIGS. 5 and 6 are rear views of alternative embodiments of the supporting base.

In the embodiment illustrated by FIG. 5, the base 50 is comprised of two perpendicular plates 80 and a lip 90. The perpendicular plates 80 may be referred to by other terms such as supports, legs, posts, or vertical tabs. The perpendicular plates 80 extend downward from either end of the lip 90 and are designed to sit between an athletic jersey 15 and shoulder pads 140 and form a clip on the jersey. That is, the lip 90 is designed to extend up and over the outer collar of the athletic jersey 15 so that the base 50 is hooked over and/or clipped to the collar of the athletic jersey 15.

Referring to FIG. 5, the lip 90 is a half-circle in shape, with the understanding that any other suitable shape may be used. The lip 90 may be sized to suitably cover the collar of an athletic jersey 15, for example having a length 93 that is 4, 4.5, 5, 5.5, 6, 6.5 or 7 inches and a width 91 that is 1, 1.5, 2, 2.5, 3, 3.5, 4, 4.5, or 5 inches. In an embodiment, the lip 90 is covered with hook-and-loop fasteners 55 such as, for example, Velcro™ for releasable attachment to the releasable portion 25 of the safety device. While a single patch or strip of hook-and-loop fasteners 55 is shown in FIG. 5, more than one patch or strip may be employed, for example, edge or border strips running along one more of the edges defined by width 91 and length 93. In an embodiment, the area of the patch of hook-and-loop fasteners 55 is equal to or greater than 10, 20, 30, 40, 50, 60, 70, 80, 90, or 100% of the area defined by the area of the lip 90, e.g., the width 91 and the length 93. In another embodiment, the lip 90 is affixed with snaps for releasable attachment to the releasable portion 25 of the athletic safety device. In other embodiments, the lip 90 is affixed with any other method, structure or means for releasable attachment that are suitable for the purposes of the invention.

Further, in the embodiment illustrated by FIG. 5, the perpendicular plates 80 are generally rectangular in shape, with the understanding that any other suitable shape may be used. The perpendicular plates 80 may have a length/height 83 that is greater than the width 81. Alternatively, the length/height 83 may be about equal to the width 81. Alternatively, the length/height 83 may be less than the width 81. The length/ height 83 and the width 81 may be independently selected as 3, 3.5, 4, 4.5, 5, 5.5, 6, 6.5, 7, 7.5, 8, 8.5, or 9 inches. In an embodiment, the two perpendicular plates 80 are identical to each other with regard to size and/or shape. In another embodiment, the two perpendicular plates 80 may be different from each other with regard to size and/or shape. The two perpendicular plates 80 and the lip 90 may be so sized, shaped, and positioned relative to each other (e.g., co-planer or substantially co-planer) such that a clip or friction-fit clamp or grip is formed on a jersey when placed between the two perpendicular plates 80 and the lip 90, for example in a paperclip-like fashion by way of analogy. In paperclip-like embodiments of the base 50, the shape of the base 50 (and the opposing structural members forming the base 50) may be any suitable shape and position that provides for the clip or friction-fit clamp or grip on a jersey placed between the opposing portions of the base 50.

In an embodiment, the shoulder pad facing side of the perpendicular plates 80 may further comprise an adhesive for attaching to the shoulder pads 140. In another embodiment, the shoulder pad facing side of the perpendicular plates 80 may comprise an adhesive and/or a hook-and-loop fastener, such as, for example, Velcro™ for attaching to the shoulder pads 140. In another embodiment, the perpendicular plates 80 comprise tabs 105. The tabs 105 may comprise slots 106, which are designed and positioned so that nut/bolts or screws may be inserted through the slots 106 and into anchor holes common on most athletic shoulder pads, in this way securing the base to the shoulder pads. The slots 106 may be sized and shaped so that any given attaching base may be used with and affixed to shoulder pads of differing sizes. Alternatively or additionally, the plates 80 may comprise one or more slots. In other embodiments, the shoulder pad facing side of the perpendicular plates 80 may comprise any other suitable method or any combination of suitable methods for attachment to the jersey and/or shoulder pads, e.g., with paperclip-like structure, adhesive, bolts and/or Velcro™. Regardless of the means for securing the base 50 to the shoulder pads and/or jersey, the attaching base is not "releasably attached" as that term is used to define the releasable attachment of the releasable portion 25 to the base 50. Specifically, the releasable portion 25 (comprising the upper support portion 20 and the lower support portion 30) is releasably attached to the base 50 (e.g., via Velcro™) such that the releasable portion 25 comes off if pulled by an opposing player while being worn during game play, whereas the base 50 (while optionally removable for example by removing bolts or other fasteners connecting the base 50 to the shoulder pads and/or jersey) is not releasably attached to the shoulder pads and/or jersey such that it comes off if pulled (directly or indirectly via the safety device 10) by an opposing player while being worn in a game. The base 50 should be considered permanently, fixedly, securely, and/or non-removably attached to the shoulder pads and/or jersey during game play. In an embodiment, the base 50 is integral to and/or formed as part of the shoulder pads, for example molded as part of the back thereof.

Figure 6:
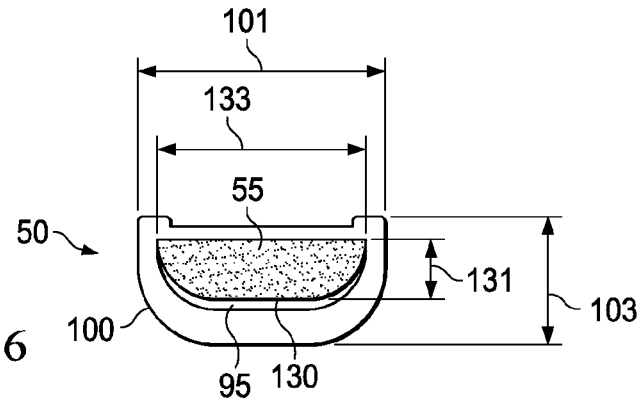

In the embodiment illustrated by FIG. 6, the base 50 is comprised of a singular plate 100 and a slit 95 cut out of the upper portion of the plate 100 creating a flap 130. The lower portion of the plate 100 is designed to sit between an athletic jersey 15 and shoulder pads 140, as shown in FIG. 5. The flap 130 can be opened and/or extended and is designed to clamp over the outer collar of an athletic jersey 15. In such an embodiment, the slit 95 is semicircular or U-shaped creating a flap 130 that is similar in shape. It should be understood that any other shape suitable for the purposes of the invention can be used for the slit 95 and the flap 130.

In the embodiments of the attaching base comprising a plate 100, the plate 100 is generally square or rectangular in shape (or has a rounded or curved lower portion), with the understanding that any other suitable shape may be used. Referring to FIG. 6, the plate may be generally rectangular or square having a width 101 and length/height 103. In an embodiment, the width 101 is about equal to the length/height 103, for example about 4×4, 4.5×4.5, 5×5, 5.5×5.5, 6×6, 6.5×6.5, 7×7, 7.5×7.5, 8×8, 8.5×8.5, or 9×9 inches. In an alternative embodiment, the width 101 and length/height 103 are different and may be independently selected as 3, 3.5, 4, 4.5, 5, 5.5, 6, 6.5, 7, 7.5, 8, 8.5, or 9 inches.

Referring to FIG. 6, the slit 95 and the resulting flap 130 (or likewise the lip 90 in the other embodiments) may be sized to suitably cover the collar of an athletic jersey 15, for example having a length 133 that is 4, 4.5, 5, 5.5, 6, 6.5 or 7 inches and a width 131 that is 1, 1.5, 2, 2.5, 3, 3.5, 4, 4.5, or 5 inches. As can be seen in FIG. 6, in an embodiment, a surface exterior to the jersey of the flap 130 (or likewise lip 90) is covered with hook-and-loop fasteners 55 such as, for example, Velcro™ for releasable attachment to the releasable portion 25 of the safety device. While a single patch or strip of hook-and-loop fasteners 55 is shown in FIG. 6, more than one patch or strip may be employed, for example, edge or border strips running along one more of the edges defined by width 131 and length 133. In an embodiment, the area of the patch of hook-and-loop fasteners 55 is equal to or greater than 10, 20, 30, 40, 50, 60, 70, 80, 90, or 100% of the area defined by the flap 130 (or likewise the lip 90), e.g., width 131 and the length 133. In another embodiment, the flap 130 is affixed with snaps for releasable attachment to the releasable portion 25 of the athletic safety device. In other embodiments, the flap 130 is affixed with any other method, structure or means for releasable attachment that are suitable for the purposes of the invention.

Figure 4:
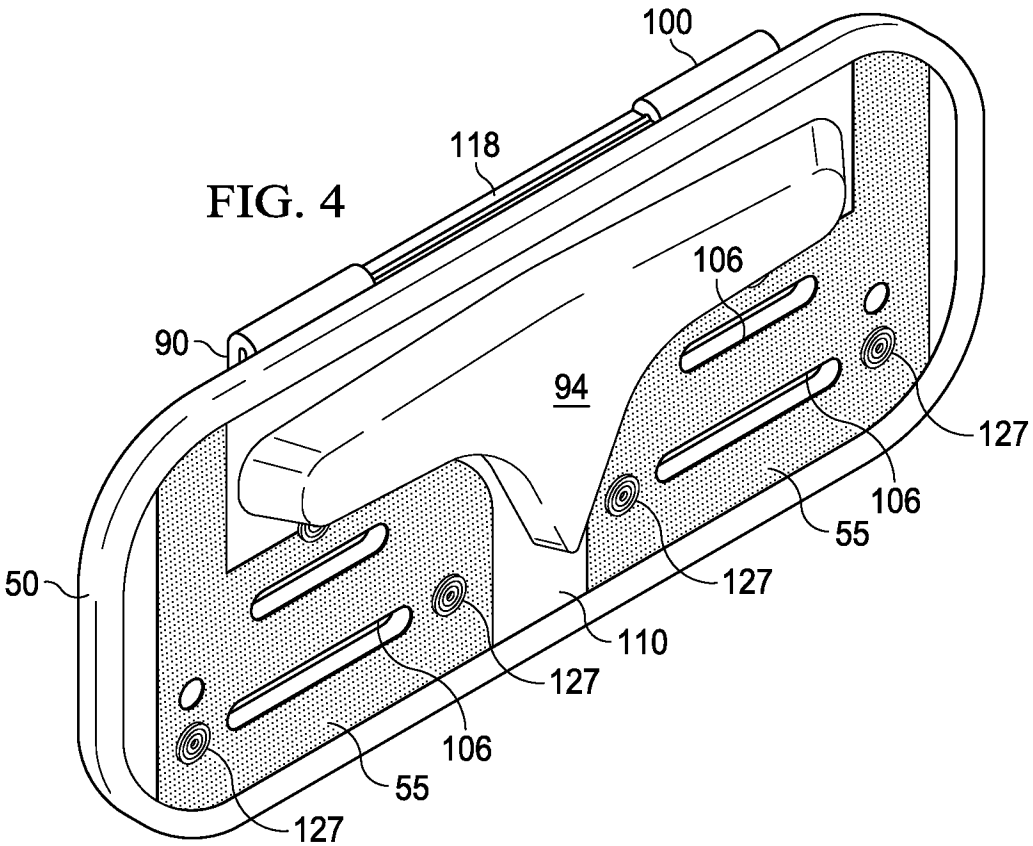
FIG. 4 is a perspective view of the interior side (i.e., the side facing the shoulder pads upon installation) of the embodiment of the base, and showing an optional T-shaped pad.

In the embodiment illustrated by FIG. 1, the base 50 is comprised of a singular plate 100 (e.g., a molded plastic plate) that curves over itself and forms a hook (e.g., a J-hook cross-section) or lip 90. The plate 100 extends downward from the lip 90 and is designed to sit between an athletic jersey 15 and shoulder pads 140, thereby having shoulder pad facing side 110 (also referred to as an interior side) and jersey facing side 120 (also referred to as an exterior side) as shown in FIGS. 3 and 4. As can be seen in FIG. 2, the lip 90 is designed to extend up and over the outer collar of the athletic jersey 15 so that the base 150 is hooked over the collar of the athletic jersey 15, thereby exposing the hook and loop fasteners 55 for releasably attaching the releasable portion 25.

In such an embodiment, the lip 90 is a semi-circle in shape (e.g., a circular segment defined by a chord), with the understanding that any other suitable shape may be used. Referring to FIG. 3, the lip 90 may be sized to suitably cover the collar of an athletic jersey 15, for example having a length 113 that is 4, 4.5, 5, 5.5, 6, 6.5 or 7 inches and a width 115 that is 1, 1.5, 2, 2.5, 3, 3.5, 4, 4.5, or 5 inches. As can be seen in FIGS. 1A and 3, in an embodiment, the lip 90 is covered with hook-and-loop fasteners 55 such as, for example, Velcro™ for releasable attachment to the safety device. While a single patch or strip of hook-and-loop fasteners 55 is shown in FIGS. 1A and 3, more than one patch or strip may be employed, for example, edge or border strips running along one more of the edges defined by width 115 and length 113. In an embodiment, the area of the patch of hook-and-loop fasteners 55 is equal to or greater than 10, 20, 30, 40, 50, 60, 70, 80, 90, or 100% of the area of the lip, e.g., as defined by the width 115 and the length 113. In another embodiment, the lip 90 is affixed with snaps for releasable attachment to the releasable portion 25 of the athletic safety device. In other embodiments, the lip 90 is affixed with any other method, structure or means for releasable attachment that are suitable for the purposes of the invention.

In an embodiment, the shoulder pad facing side 110 of the plate 100 may comprise an adhesive, hook and loop fastener, holes, slots, belts, straps, buckles, and the like, or combinations thereof, or other means for attaching to the shoulder pads 140. As shown in FIGS. 1, 3, and 4, the base 50 may comprise a plurality of holes or slots 106 for attaching the base to the shoulder pads 140 via bolts or screws 107 (e.g., a plastic bolt, washer and nut such as a T-nut). As can be seen in FIG. 5, in another embodiment, the plate 100 comprises tabs 105 having slots 106, which are designed and positioned so that bolts or screws 107 may be inserted through the slots 106 and into anchor holes common on most athletic shoulder pads, in this way securing the base 50 to the shoulder pads 140. The slots 106 may be sized and shaped so that any given attaching base may be used with and affixed to shoulder pads of differing sizes. As can be seen in FIG. 4, in another embodiment, the shoulder pad facing side 110 of the plate 100 may comprise a hook-and-loop fastener 55, such as, for example, Velcro™, and/or an adhesive for attaching to the shoulder pads 140. In such embodiments, the hook and loop fasteners and/or adhesive may be used alone or in combination with other means such as bolt and nuts, provided that the base is securely attached to the shoulder pads such that it does not separate from the shoulder pads during use in game play (in contrast to the releasable portion 25). In other embodiments, the shoulder pad facing side of the plate 100 may comprise any other suitable method or any combination of suitable methods for attachment to the shoulder pads. As described previously, the force required to release the releasable portion 25 from the base 50 via the releasable means (e.g., hook and loop fastener 25) is less than the force required to rip, tear, break, or otherwise forcibly remove or cause structural damage or failure of the base when installed on the shoulder pads 140 (e.g., via deforming or structural damaging the base such as the slots 106 or the means for connecting the base to the shoulder pads such as shearing or damaging the bolts 107), for example during game play. In an embodiment, the force required to rip, tear, break, or otherwise forcibly remove or cause structural damage or failure of the base when installed on the shoulder pads 140 is greater than 25, 30, 35, 40, 45, 50, 60, 70, 80, 90, or 100 pounds.

As can be seen in FIG. 4, in an embodiment, edges of the plate 100 and/or a portion of the shoulder pad facing side 110 comprises padding or an impact absorbent material 94 such as, for example, foam rubber, polyurethane foam, latex foam rubber, visco-elastic polyurethane foam (e.g., memory or slow recovery foam), polyester foam, neoprene rubber, and the like. In an embodiment, the foam is integral skin foam, for example, having a high density skin and a low density core. In an embodiment, a foam core surrounding all or a portion of the plate 100 is encased within a protective skin layer such as neoprene rubber skin layer. The impact absorbent material 94 may be sized and positioned to give optimal cushioning behind an athlete's neck and avoids any sharp, hard or rough edges thereby promoting safety and comfort for the athlete.

In an embodiment, the base 50 may comprise addition support structure to reinforce the unitary plate 100. For example as shown in FIGS. 3 and 4, a support plate 125 may be attached to the unitary plate 100, for example via rivets 127 or other attaching means. The size of the support plate (e.g., width, height, thickness, etc.) may be selected to provide a desired level of structural support to the unitary plate 100 or to otherwise aid in the attachment of the base 50 to the shoulder pads 140 (e.g., to provide adequate spacing or positioning, for example to serve as a universal adapter for attachment to various sizes, types, designs, brands, etc. of shoulder pads, etc.). In an embodiment, a cutout 118 may be formed over a length of the curved portion of lip 90, for example to aid in the formation of the lip 90 and/or to provide some flexibility in movement of the lip 90 to aid in placement of the collar of jersey 15 under the lip 90 while the safety device 10 is attached to the shoulder pads 140.

In an embodiment, the athletic safety device 10 is designed to be situated at the back shoulders, neck and upper spine of an athlete. In an embodiment, the athletic safety device is situated proximate with the intersection of the cervical spine and thoracic spine. In an embodiment, the athletic safety device is situated above the intersection of the cervical spine and thoracic spine. In another embodiment, the athletic safety device is proximate to 2 vertebrae up or down from the intersection of the cervical spine and the thoracic spine. In another embodiment, the athletic safety device is proximate to 3 vertebrae up or down from the intersection of the cervical spine and thoracic spine. In another embodiment, the athletic safety device is proximate to 4 vertebrae up or down from the intersection of the cervical spine and thoracic spine. In an embodiment, the athletic safety device is situated proximate with the "cup" of the neck, and such placement may aid in the prevention of a whiplash motion of the head and/or neck. In yet another embodiment, as shown in FIG. 1B the central axis 27 of the upper cushioning portion 20 is about parallel with a plane of the shoulders and about perpendicular to the spinal column of the athlete. In an embodiment, the lower support portion in generally square or rectangular (or having a curved lower portion) having front and back faces, and a plane of the front or back face is positioned about parallel with a plane of the back, the upper back, or the shoulder blades of the athlete.

In an embodiment, the athletic safety device may be customizable with regard to appearance. The athletic safety device can be any color or any combination of colors. Further, print, images, or both can be included on the athletic safety device. As can be seen in FIG. 1, in a given embodiment, the athletic safety device (e.g., the releasable portion 25) is customized with a brand name image such as stitching 38 in the shape of an "X" denoting a safety device available from The X Collar Corporation. Alternatively, the athletic safety device may be customized with a brand name image, a team name image, a team logo image, an athlete name image, an athlete number image, a company sponsor name image, a company sponsor advertising image, or any other image or any combination of images.

In an embodiment, the athletic safety device may be customizable with regard to size. The athletic safety device can be made in any number of sizes and should be sized to optimally prevent a horse-collar tackle of an athlete wearing athletic shoulder pads and an athletic jersey. For example, the athletic safety device would be sized smaller for high school athletes. For college and professional athletes, the athletic safety device would be sized larger. In an embodiment, the athletic safety device may be sized specifically for personal size requirements of individual athletes.

In a given embodiment, the interior side or face (e.g., the side or face of the safety device facing the back of the jersey) of the releasable portion 25 of the athletic safety device is colored yellow similar to the yellow color of an American football penalty flag. In this embodiment, when a horse-collar tackle is attempted and an opposing player grabs the athletic safety device, the athletic safety device will release from the athletic equipment to which it is attached and the yellow side will be exposed signifying the banned tackle was attempted.

In an embodiment, all or a portion of the athletic safety device (e.g., the removable portion 25) further comprises a fixed or removable cover. In an embodiment, the removable cover is designed so that it can be fully removed from the athletic safety device. The removable cover can be removed for the purpose of washing, to be replaced with another removable cover (for example, to change colors to match home or away jerseys), or for any other reason. The removable cover can be made of fabric, mesh, or any other material suitable for the purposes of the invention and should be sized to snugly fit the athletic safety device for which it is intended. In an embodiment, the removable cover is customizable with regard to appearance. The removable cover can be any color or any combination of colors, for example the same color as the jersey. Print or images can be included on the removable cover. In a given embodiment, the removable cover can be customized with a brand name image such as a printed or stitched "X" denoting a safety device available from The X Collar Corporation. Alternatively, the removable cover can be customized with a brand name image, a team name image, a team logo image, an athlete name image, an athlete number image, a company sponsor name image, a company sponsor advertising image, or any other image, or any combination of images. In an embodiment, the interior side of the removable cover installed upon the releasable portion 25 is colored yellow similar to the yellow color of an American football penalty flag. When a horse-collar tackle is attempted and an opposing player grabs the athletic safety device, the athletic safety device will release from the athletic equipment to which it is attached, and the yellow side of the removable cover will be exposed signifying the banned tackle was attempted.

In an embodiment, the removable cover covers the releasable portion 25 of the athletic safety device, and therefore the removable cover is releasably attached to the piece of athletic equipment (e.g., jersey) or the attaching base as described previously. In a given embodiment, the removable cover is attached to the piece of athletic equipment or the attaching base using hook-and-loop fasteners such as, for example, Velcro™ with the hook side on the removable cover and the loop side on the piece of athletic equipment (e.g., jersey) or attaching base. Alternatively, the removable cover may be attached to the piece of athletic equipment or the attaching base using hook-and-loop fasteners such as, for example, Velcro™ with the loop side on the removable cover and the hook side on the piece of athletic equipment (e.g., jersey) or attaching base. In another embodiment, the removable cover is attached to the piece of athletic equipment or the attaching base with snaps. In other embodiments, the removable cover is attached to the piece of athletic equipment (e.g., jersey) or the attaching base using any method suitable for the purposes of the invention.

In an embodiment, the athletic safety device disclosed above is consistent for use as part of an athletic safety system. The system comprises an athletic safety device and a piece of athletic equipment. In an embodiment, the athletic safety device comprises a releasable portion (e.g., having an upper cushioning portion and a lower support portion) and optionally a base. In another embodiment, the athletic safety device comprises a releasable portion (e.g., a cushioned support without a lower support potion) and optionally a base. The piece of athletic equipment may be any suitable piece of athletic equipment as described herein, e.g., shoulder pads. In one embodiment of this system, the athletic safety device and the piece of athletic equipment have a cooperative means for releasably attaching the athletic safety device (e.g., the releasable portion) to the piece of athletic equipment. In an alternative embodiment of this system, the athletic safety device (e.g., the releasable portion) and an attaching base, which is affixed to the piece of athletic equipment, have a cooperative means for releasably attaching the releasable portion of the athletic safety device to the attaching base. In both embodiments, the releasable portion is releasably attached such that the athletic safety device is positioned at the back shoulders, neck and upper spine of an athlete. Further, the cooperative means of releasably attaching the releasable portion of the athletic safety device to the piece of athletic equipment (e.g., jersey) or to the attaching base is such that the releasable portion of the safety device releases from the piece of athletic equipment or the attaching base when the athletic safety device is grabbed by an opposing player during game play. The cooperative means of releasably attaching may be a hook-and-loop fastener, snaps, or any other attaching method suitable for the purposes of the invention.

In an embodiment, the athletic safety device disclosed above is consistent for use as part of a method for preventing injury to an athlete due to horse-collar tackling. The method includes releasably attaching the releasable portion of the athletic safety device to a piece of athletic equipment or to an attaching base affixed to a piece of athletic equipment to be worn by an athlete. In one embodiment, the releasable portion of the athletic safety device comprises an upper cushioning portion and a lower support portion. In another embodiment, the releasable portion of the athletic safety device comprises a cushioned support. The piece of equipment may be any suitable piece of athletic equipment as described herein, for example a jersey and/or shoulder pads. The releasable portion of the athletic safety device is releasably attached to the piece of athletic equipment or to the attaching base using a hook-and-loop fastener, snaps, or any other method of attaching suitable for the purposes of the invention. The releasable portion of the athletic safety device is releasably attached to the piece of athletic equipment or to the attaching base so that the safety device is situated at the back shoulders, neck and upper spine of the athlete such that the athletic safety device blocks access to the athletic shoulder pads and back athletic jersey collar of the athlete. Further, the releasable portion of the safety device should be releasably attached in such a way that the safety device will release from the piece of safety equipment or the attaching base to which it was attached when grabbed by an opposing player during gameplay. This release will prevent a horse-collar tackle and the possible resulting injuries.

In an embodiment, the safety device further comprises packaging and instructions (e.g., written instructions on paper or accessible via a website or the like) for installation and use of the safety device on athletic equipment such as shoulder pads. In an embodiment, a method of instructing an athlete on installation and/or use of the safety device is provided. In an embodiment, the instructions comprise, for example, to apply the safety device (e.g., an X Collar) to the shoulder pads:

1. Place nuts (e.g., T-nuts) adjacent the anchor holes in between the cloth padding and plastic in the back of the shoulder pads facing out.

2. Place the X Collar base pad on the shoulder pads aligning the slots in the base pad with the anchor holes so that the top of the base pad is even with the jersey collar.

3. Place washers on to mounting screws and place screws with washers through the receiving slots on the base pad and into the nuts on the back of the shoulder pads.

4. Screw base pad down tight, securing the base pad to the back of the shoulder pads.

5. Place jersey over the shoulder pads, exposing the lip of the base outside the jersey.

6. Attach the releasable portion to the base lip using the Velcro™ attached to each component.

Do Not Drill Shoulder Pads as this could jeopardize the strength and safety of pads. WARNING! Football is a dangerous sport. The X Collar Corporation does not claim that the X Collar will prevent any injuries associated with the Horse Collar Tackle. X Collar Corporation SW 19 St. Wagoner Okla. 74467. Thexcollar.com.

ADDITIONAL EMBODIMENTS

The following are nonlimiting, specific embodiments in accordance with the present disclosure:

Embodiment 1

An athletic safety devise comprising:

an upper cushioning portion; and a lower support portion, wherein the athletic safety device is positioned at the upper back spine and shoulders of an athlete, and wherein the athletic safety device is releasably attached to a piece of athletic equipment or an attaching base secured to the piece of athletic equipment such that the safety device is operable to release upon grasping by an opposing player during game play, thereby preventing a horse-collar tackle and possibility for resultant injury to the athlete.

Embodiment 2

An athletic safety device comprising:

a cushioned support releasably attached to a piece of athletic equipment or to a base secured to the piece of athletic equipment, wherein the athletic safety device is positioned at the upper spine and back shoulders of an athlete, and wherein the athletic safety device is releasably attached to the piece of athletic equipment or the base such that the safety device is operable to release upon grasping by an opposing player during game play, thereby preventing a horse-collar tackle and possibility for resultant injury to the athlete.

Embodiment 3

An athletic safety devise comprising an upper cushioning portion;

a lower support portion; and means for releasably attaching the safety device to a piece of athletic equipment or a base secured to the piece of athletic equipment, said means further providing that the athletic safety device is positioned at the upper back spine and shoulders of an athlete when wearing the safety device, and wherein the athletic safety device is releasably attached to the piece of athletic equipment or base such that the safety device is operable to release upon grasping by an opposing player during game play, thereby preventing a horse-collar tackle and possibility for resultant injury to the athlete.

Embodiment 4

An athletic safety system comprising:

an anti-horse collar tackle device comprising an upper cushioning portion and a lower support portion; and athletic equipment selected from a jersey or shoulder pads, wherein the device and athletic equipment have cooperative means for means for releasably attaching the safety device to a piece of athletic equipment such that the athletic safety device is positioned at the upper back spine and shoulders of an athlete when wearing the safety device, and wherein the athletic safety device is releasably attached to a piece of athletic equipment or a base secured to the piece of athletic equipment such that the safety device is operable to release upon grasping by an opposing player during game play, thereby preventing a horse-collar tackle and possibility for resultant injury to the athlete.

Embodiment 5

A method for preventing injury to an athlete due to horse-collar tackling, comprising:

releasably attaching a cushioned support to a piece of equipment to be worn by the athlete, wherein the athletic safety device is positioned at the upper spine and back shoulders of an athlete and wherein the athletic safety device is releasably attached to the piece of athletic equipment such that the safety device is operable to release upon grasping by an opposing player during game play, thereby preventing a horse-collar tackle and possibility for resultant injury to the athlete.

Embodiment 6

The athletic safety device of any preceding embodiment wherein the safety device is releasably attached to a jersey placed over shoulder pads, and wherein the cushioned support is sized and positioned to substantially prevent a horse collar tackle of an athlete wearing the shoulder pads and jersey.

Embodiment 7

The athletic safety device of any preceding embodiment wherein the safety device is releasably attached to shoulder pads, and wherein the cushioned support is sized and positioned to substantially prevent a horse collar tackle of an athlete wearing the shoulder pads.

Embodiment 8

The athletic safety device of any preceding embodiment wherein the sizing and positioning of the cushion support further aids in preventing a whiplash motion of the head and/or neck of the athlete.

Embodiment 9

The athletic safety device of any preceding embodiment wherein the upper cushioning portion is thicker than the lower support portion.

Embodiment 10

The athletic safety device of any preceding embodiment wherein the upper cushioning portion and/or the lower support portion comprises impact absorbent material.

Embodiment 11

The athletic safety device of embodiment 10 wherein the impact absorbent material is foam.

Embodiment 12

The athletic safety device of any preceding embodiment wherein the lower support portion further comprises a plastic insert.

Embodiment 13

The athletic safety device of any preceding embodiment further comprising a removable cover.

Embodiment 14

The athletic safety device of embodiment 13 wherein the removable cover comprises fabric.

Embodiment 15

The athletic safety device of embodiment 13 wherein the removable cover comprises foam.

Embodiment 16

The athletic safety device of embodiment 13 wherein the removable cover is customized with a team or player identification.

Embodiment 17

The athletic safety device of embodiment 13 wherein the removable cover is customized with a team logo or an athlete's name or number.

Embodiment 18

The athletic safety device of any preceding embodiment wherein the athletic safety device is releasably attached to a piece of athletic equipment with a hook and loop fastener such as Velcro™.

Embodiment 19

The athletic safety device of any preceding embodiment wherein the athletic safety device is releasably attached to a piece of athletic equipment with snaps.

Embodiment 20

The athletic safety device of any preceding embodiment wherein the athletic equipment is shoulder pads, a jersey, or both.

Embodiment 21

The athletic safety device of any preceding embodiment wherein the device is positioned proximate the intersection of the cervical spine and the thoracic spine.

Embodiment 22

The athletic safety device of embodiment 21 wherein the device is positioned within 3 vertebrae upon or down from the intersection of the cervical spine and the thoracic spine.

Embodiment 23

The athletic safety device of any preceding embodiment wherein a central axis of the upper cushioning portion or the cushioned support is about parallel with a plane of the shoulders and about perpendicular to the spinal column of the athlete.

Embodiment 24

The athletic safety device of any preceding embodiment wherein the device is positioned proximate the shoulder blades of the athlete.

Embodiment 25

The athletic safety device of any preceding embodiment wherein the lower support portion is positioned about parallel with the back, the upper back, or the shoulder blades of the athlete.

Embodiment 26

The athletic safety device of any preceding embodiment wherein the athlete is a player of American football.

Embodiment 26

The athletic safety device of any preceding embodiment further comprising the base and/or the means for releasably attaching the attaching base to the safety device.

Embodiment 27

The athletic safety device of any preceding embodiment further comprising packaging and instructions for installation of the device on athletic equipment such as shoulder pads.

Embodiment 28

The athletic safety device of any preceding embodiment further comprising means for attaching the safety device to athletic equipment such as bolts for attaching the base to shoulder pads.

Embodiment 29

An athletic safety system comprising:

an anti-horse collar tackle device comprising an upper cushioning portion and a lower support portion; and a base having means for securing the attaching base to athletic equipment selected from a jersey and/or shoulder pads, wherein the device and the base have cooperative means for releasably attaching the safety device to the attaching base such that the athletic safety device is positioned at the upper back spine and shoulders of an athlete when wearing the safety device, and wherein the athletic safety device is releasably attached to the attaching base secured to the piece of athletic equipment such that the safety device is operable to release upon grasping by an opposing player during game play, thereby preventing a horse-collar tackle and possibility for resultant injury to the athlete.

Embodiment 30

The athletic safety system of embodiment 29 wherein the base further comprises slots and the means for securing the attaching base to the athletic equipment is bolts extending through the slots and into holes in the shoulder pads.

Embodiment 31

The athletic safety system of embodiment 30 wherein the attaching base further comprises a lip extending up and over the collar of the jersey, the cooperative means for releasably attaching the safety device to the attaching base is a hook and loop fastener, and the outer surface of the lip comprising a portion of a hook and loop fastener.

Embodiment 32

A shoulder pad accessory system comprising:

a base component configured for attachment to a back region of a shoulder pad; and a forcibly detachable safety component configured for attachment to the base component, wherein upon attachment to the base component, the safety component is detachable from the base component via application of a human applied detaching force.

Embodiment 33

The shoulder pad accessory system of embodiment 32 wherein the human applied detaching force is no more than 0.5, 1, 3, 5, 7, 10, 20 or 25 pounds.

Embodiment 34

A shoulder pad system comprising a forcibly detachable safety component configured for attachment to a back region of a shoulder pad, wherein upon attachment to the shoulder pad, the safety component may be detached from the shoulder pad via application of a human applied detaching force.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference herein is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. An anti-horse collar tackle safety device, comprising:

a base having means for attaching the base to a pair of shoulder pads, wherein the base comprises an interior portion facing the shoulder pads, the interior portion extending upward from the shoulder pads to about a collar of the shoulder pads and turning back downward away from the collar of the shoulder pads to provide a downward projecting exterior portion of the base that is accessible from outside a jersey placed over the shoulder pads, the downward projecting exterior portion of the base overlying the interior portion of the base in a substantially U-shaped or J-hook shaped configuration to form a recess for receiving a portion of a collar of the jersey; and a releasable portion releasably attached to the exterior portion of the base via means for releasable attachment, wherein the releasable portion is configured to release upon grasping by an opposing player during gameplay.

2. The device of claim 1, wherein the means for releasable attachment comprise a hook and loop fastener.

3. The device of claim 2, wherein the base comprises a J-hook shaped plastic plate having a lip, and the lip comprises the downward projecting exterior portion that is accessible from outside the jersey.

4. The device of claim 3, wherein a portion of the hook and loop fastener is attached to the lip.

5. The device of claim 4, wherein the releasable portion comprises an upper cushioning portion and a lower support portion.

6. The device of claim 5, wherein the upper cushioning portion is thicker than the lower support portion.

7. The device of claim 6, wherein the upper cushioning portion is sized and positioned to substantially block or impede access to a collar of the shoulder pads, the jersey, or both.

8. The device of claim 7, wherein the upper cushioning portion comprises a cylindrical roll.

9. The device of claim 8, wherein the base comprises a plurality of holes or slots.

10. The device of claim 9, further comprising a plurality of bolts and nuts, wherein the bolts and nuts are sized to fit within the holes or slots and extend into corresponding holes or slots in the shoulder pads.

11. The device of claim 10, further comprising instructions for installation of the device on the shoulder pads.

12. The device of claim 1, wherein the releasable portion is configured to release upon grasping by an opposing player during gameplay via application of a force equal to or less than about 15 pounds.

13. An anti-horse collar tackle safety device, comprising:

a releasable portion comprising an upper cushioning portion and a lower support portion; and a base having means for securing the base to athletic equipment selected from a jersey or shoulder pads, wherein the base comprises an interior portion facing the jersey or shoulder pads, the interior portion extending upward from the jersey or shoulder pads to about a collar of the jersey or shoulder pads and turning back downward away from the collar of the jersey or shoulder pads to provide a downward projecting exterior portion of the base that is accessible from outside the jersey, the downward projecting exterior portion of the base overlying the interior portion of the base in a substantially U-shaped or J-hook shaped configuration to form a recess for receiving a portion of the collar of the jersey, wherein the releasable portion and the base have cooperative means for releasably attaching the releasable portion to the attaching base such that the releasable portion is positioned proximate the collar of the jersey or shoulder pads of an athlete when wearing the safety device, and wherein the releasable portion is releasably attached to the base and the base is non-releasably secured to the piece of athletic equipment such that the releasable portion is operable to release upon grasping by an opposing player during game play and the non-releasable secured base does not release from the piece of athletic equipment upon grasping of the releasable portion by an opposing player during game play, thereby preventing a horse-collar tackle and possibility for resultant injury to the athlete.

14. The device of claim 13, wherein the base further comprises holes or slots and the means for securing the base to the athletic equipment is bolts extending through the slots or holes and into holes in the shoulder pads and nuts attached to the bolts.

15. The device of claim 14, wherein the downward projecting exterior portion of the base forms a lip extending over and down from the collar of the jersey, the cooperative means for releasably attaching the safety device to the base is a hook and loop fastener, and the outer surface of the lip comprises a portion of athe hook and loop fastener.

16. The device of claim 15, further comprising instructions for installation of the device on the shoulder pads.

* * * * *